US007681695B2

(12) United States Patent
Christen

(10) Patent No.: US 7,681,695 B2
(45) Date of Patent: Mar. 23, 2010

(54) METHOD OF MODERNIZING THE CAR DOOR SYSTEM OF AN ELEVATOR, AND MODERNIZING CONSTRUCTIONAL SET FOR CARRYING OUT THE METHOD

(75) Inventor: Jules Christen, Altdorf (CH)

(73) Assignee: Inventio AG, Hergiswil NW (CH)

( * ) Notice: Subject to any disclaimer, the term of this patent is extended or adjusted under 35 U.S.C. 154(b) by 206 days.

(21) Appl. No.: 11/677,157

(22) Filed: Feb. 21, 2007

(65) Prior Publication Data

US 2007/0227829 A1 Oct. 4, 2007

(30) Foreign Application Priority Data

Feb. 21, 2006 (EP) ..... 06110242

(51) Int. Cl.
*B66B 13/12* (2006.01)
*E05C 7/06* (2006.01)

(52) U.S. Cl. ..... 187/319; 187/330; 187/334; 49/118; 49/120

(58) Field of Classification Search ..... 187/319, 187/330, 327, 334–335; 49/116–120
See application file for complete search history.

(56) References Cited

U.S. PATENT DOCUMENTS 4,926,974 A * 5/1990 Morris et al. ..... 187/319
5,878,846 A * 3/1999 O'Donnell ..... 187/318
2005/0126861 A1 6/2005 Bisang et al.
2005/0139429 A1 * 6/2005 Bisang et al. ..... 187/319

FOREIGN PATENT DOCUMENTS

| | | | |
|---|---|---|---|
| EP | 0332841 | A | 9/1989 |
| JP | 07196275 | A | 8/1995 |
| JP | 09086824 | A | 3/1997 |
| JP | 2000289955 | A | 10/2000 |

* cited by examiner

*Primary Examiner*—John Q Nguyen
*Assistant Examiner*—Stefan Kruer
(74) *Attorney, Agent, or Firm*—Fraser Clemens Martin & Miller LLC; William J. Clemens

(57) ABSTRACT

A method of modernizing the car door system of a elevator car, which originally comprises at least one car door leaf, a door drive with a crank gear and a drive linkage displacing the car door leaf and a car door/shaft door coupling actuated by the drive linkage, with the following method steps: demounting the door drive together with the crank gear and the drive linkage, mounting a door drive with a linearly moved drive means and coupling of the drive means with the car door leaf of the original car door system, and mounting an actuating device for actuating the car door/shaft door coupling.

12 Claims, 3 Drawing Sheets

METHOD OF MODERNIZING THE CAR DOOR SYSTEM OF AN ELEVATOR, AND MODERNIZING CONSTRUCTIONAL SET FOR CARRYING OUT THE METHOD

FIELD OF THE INVENTION

This invention relates to a method of modernizing the car door system of an elevator car, to a modernizing constructional set with components required for carrying out the method, and to an elevator car with a car door system which was modernized according to the method or by the modernizing constructional set. It also relates to the problem of so modernizing car door systems of older elevator installations that they have advantageous operating characteristics attainable with new technologies.

BACKGROUND OF THE INVENTION

A large number of older car door systems is in use worldwide, in which a crank drive of the door drive in each instance moves at least one car door leaf by way of a drive linkage. In that case usually a crank arm, which can also be present in the form of a crank disc, is so driven by a drive motor in the form of an electric motor via reduction gearing that the crank arm for producing an opening movement or a closing movement of the at least one car door leaf executes a pivot movement of preferably approximately 180°. A crank rod is connected at one end thereof with the end of the crank arm and at the other end thereof with a door drive lever, which is pivotably mounted on a frame of the door drive and coupled at its end with the car door leaf. The components of the described door drive are so shaped and arranged that half a revolution of the crank arm produces a full opening or closing movement of the door leaf, wherein the crank gear ensures an approximately sinusoidal, jolt-free movement of the door leaf with precisely defined end settings. In the case of door systems with more than one car door leaf a second car door leaf can be driven symmetrically with respect to the first car door leaf by the same crank arm via a second crank rod and a second door drive lever.

So that the movement of the car door leaf can be transmitted to the shaft door leaf present at each floor there is usually present at the car door leaf a car door/shaft door coupling which is actuated when the elevator car stops at a floor and which connects the car door leaf with the corresponding shaft door leaf. The car door/shaft door coupling comprises two parallel entrainer skids which are arranged vertically at the car door leaf and which on stopping at a floor come to lie between two counter-bodies—usually in the form of entrainer rollers—present at the shaft door leaf.

The door drive lever is so connected with the car door leaf by way of an adjusting element of the car door/shaft door coupling that at the beginning of the opening movement of the car door leaf the door drive lever imposes on the adjusting element a movement having the consequence of spreading the entrainer skids, whereby a play-free connection between the entrainer skids and the counter-bodies, i.e. a play-free connection between the car door leaf and the shaft door leaf, arises. The door leaves are now synchronously opened and later closed again. At the end of the door closing process the two entrainer skids at the car door leaf are brought into their unspread normal setting by the action of the door drive lever on the said adjusting element, whereby the play-free connection between the car door leaf and the shaft door leaf is cancelled.

Door drives of the described kind have some disadvantages which are briefly explained in the following: The opening and closing movement of the door leaf takes place with an invariable sinusoidal speed course. It is not possible to achieve an optimally small opening and closing time, particularly in the case of wide elevator doors, with such a speed course and with a maximum speed limited for safety reasons. It is also not possible to realize adaptability of the speed course to special situations such as have proved advantageous in the case of, for example, elevators often used by handicapped or elderly passengers. Generation of the door leaf movement by a crank gear additionally has the consequence of a substantial dependence of the closing force on the instantaneous position of the door leaf, i.e. an extremely high closing force can be produced shortly before reaching the closed setting which in the event of failure of a person detection system can lead to situations of being caught. A currently usual method of detecting obstacles by monitoring the motor current or the motor torque at the door drive motor cannot be realized in feasible manner in the case of a door drive with crank gear. The crank gear with reduction gearing and drive linkage moreover forms a source of loud noise which is hardly accepted any longer in current elevator installations. A significant disadvantage is, moreover, to be seen in the fact that the mechanically relatively complex door drive with drive motor, motor brake, crank gear with reduction gearing and several lever joints requires a substantial outlay for checking, maintenance and readjusting and for periodic replacement of the brake linings of the drive motor.

The present invention has the object of proposing measures making it possible to eliminate, with smallest possible cost, the aforesaid disadvantages in existing elevator installations having door leaves moved by a door drive with crank gear and drive linkage. In particular, the measures shall serve for increasing the transport capacity through reducing opening and closing times of the door leaf, reliable avoidance of impermissibly high closing forces, adaptation of the course of the closing speed to special circumstances and minimization of noise output by the door system, wherein the overall cost for such a modernization and also the required conversion time shall be kept as small as possible.

SUMMARY OF THE INVENTION

The object is fulfilled by a method according to the present invention for modernization of the afore-described car door systems, by a modernizing constructional set according to the present invention for modernizing such car door systems and by an elevator car with a car door system modernized by a method according to the present invention or by the modernizing constructional set according to the present invention.

In the case of the method according to the present invention, a car door system, which comprises at least one car door leaf, a car door drive with a crank gear and a drive linkage displacing the car door leaf and a car door/shaft door coupling actuated by the drive linkage, is modernized by the following steps:

- demounting the door drive together with the crank gear and the drive linkage,
- mounting a door drive with a linearly moved drive means and connecting the drive means with the car door leaf of the original car door system, and
- mounting an actuating device for actuating the car door/shaft door coupling.

The modernizing constructional set according to the present invention is characterized in that the modernized car door system consists of two groups of components, wherein a first group comprises at least one car door leaf and at least one car door/shaft door coupling connected with the car door leaf, and a second group comprises a door drive with a linearly moved drive means connected with the car door leaf and an actuating device for actuating the car door/shaft door coupling, and the components of the first group are parts of the original car door system and the components of the second group are parts of the modernizing constructional set.

By the expression "linearly moved drive means" there is to be understood a part of a drive device, the component of which—which acts on the object to be driven—executes a linear (straight) movement. Drive devices with such drive means are, for example:

a cogged belt or nubbed belt, which is guided by two belt pulleys and driven by these and the belt runs of which extending between the belt pulleys form a linearly (straight) moved drive means, a link chain, roller chain or ball chain guided and driven by two sprockets, a linear motor, or a pneumatic or hydraulic cylinder with a linearly moved piston rod.

The present invention is accordingly based on the concept of eliminating the aforesaid disadvantages of car door systems, in which the door leaves are moved by a door drive with crank gear and drive linkage, with smallest possible cost by a modernization in which the originally present case door leaf, at least part of its guide system and the car door/shaft door coupling present at at least one car door leaf are reused, the existing car door drive is replaced by a new door drive with a linearly moved drive means and an actuating device for actuating the car door/shaft door coupling, which was previously actuated by the drive linkage of the original car door drive, is mounted.

The advantages achieved by the method according to the present invention or by the use of a modernizing constructional set according to the present invention or by the elevator car according to the present invention are essentially to be seen in that the aforesaid disadvantages of the original door drive with crank gear are eliminated and the advantageous operating characteristics of a modern door drive with linearly moved drive means are achieved without the car door leaf, the guide system thereof and the car door/shaft door coupling also having to be replaced. These components, which represent a substantial proportion of the overall cost for a car door system, are, in most cases in modernizations of elevator installations, in technically faultless state so that the use thereof is feasible and very cost-saving.

Advantageous refinements and developments of the method according to the present invention and of the modernizing constructional set are described in the following:

According to a particularly preferred embodiment of the invention a flexible traction means, for example in the form of a cogged belt, guided and driven by drive means pulleys is used as linearly moved drive means. Thus, in combination with a door drive motor, an extremely simple and economic drive arrangement can be realized, which on the one hand enables a simple coupling between a new door drive motor and the original car door leaves and on the other hand always ensures a speed of the door leaf which is precisely proportional to the variable rotational speed of the door drive motor.

Shortest possible opening and closing times, secure limitation of the closing force and optimum possibilities with respect to adaptation of the operating characteristics of the modernized door drive to special use circumstances are achieved in that at least one of the door drive means pulleys and thus also the linearly moved drive means are driven by a door drive motor, the rotational speed and torque of which can be controlled and regulated in position-dependent manner by means of a control and regulating apparatus according to programmed presets. An integrated path measuring system supplies for that purpose the requisite information about the current position of the car door leaf.

The car door leaf is advantageously connected with the linearly moved drive means by way of a rigid connecting element or by way of a pivot lever of the actuating device controlling the car door/shaft door coupling.

According to an advantageous form of embodiment of the present invention the actuating device is mounted on the car door leaf, wherein the actuating device comprises a transmission element which is brought into operative connection with an adjusting element, for example an adjusting lever, of the car door/shaft door coupling in order to bring the car door/shaft door coupling into coupling setting or into uncoupling setting depending on the position of the car door leaf.

According to a preferred embodiment of the invention the actuating device is so conceived that its transmission element—in the course of the last path section of the closing movement of the car door leaf or of the drive means is caused to make a movement which brings the car door/shaft door coupling into decoupling setting and—in the course of a first path section of the opening movement of the car door leaf or of the drive means is caused to make a movement which brings the car door/shaft door coupling into coupling setting.

Advantageously, the said movement of the transmission element and thus the actuation of the car door/shaft door coupling is derived from the movement of the car door leaf or of the linearly moved drive means, so that no additional drive device is required for that purpose.

A simple and economic embodiment of the invention consists in that a control cam fixedly connected with the elevator car is mounted and causes the movement of the transmission element by way of a cam scanning element of the actuating device fastened to the car door leaf.

A particularly advantageous development of the invention consists in that the pivot lever, which is present at the actuating device, is coupled with the transmission element and connected with the drive means, so that on the one hand the movement of the car door leaf and on the other hand the movement of the transmission element, after conclusion of the closing movement and also before the beginning of the opening movement of the car door leaf, are produced by the drive means by way of the pivot lever. The actuation of the car door/shaft door coupling can thereby be effected on each occasion before the actual opening or closing movement of the car door leaf and the corresponding shaft door leaf begins.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1A:
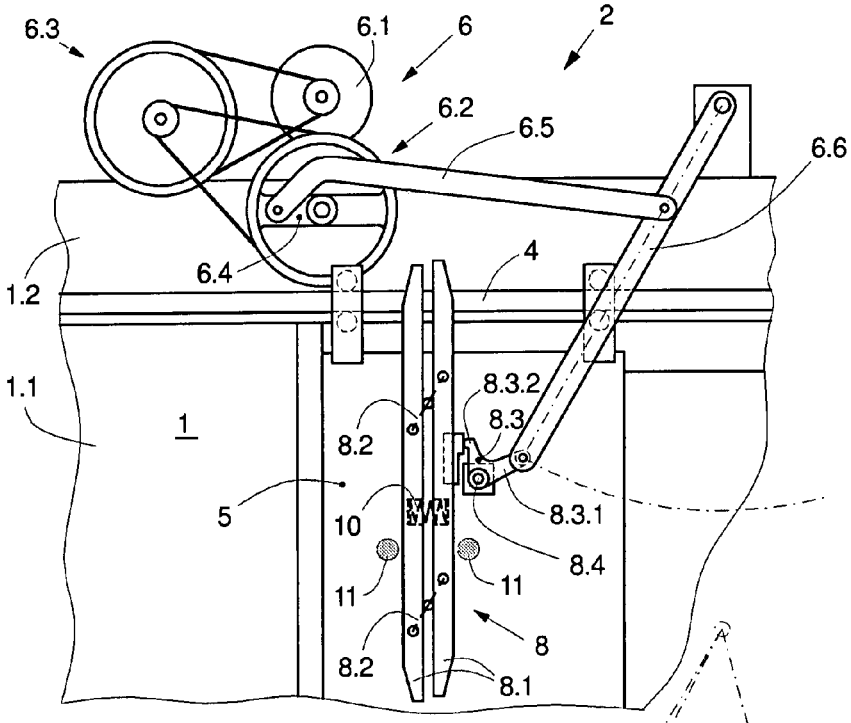
FIG. 1A is a schematic view of a prior art car door system with crank gear drive in the original state prior to modernization, as seen from the shaft door, of the car front, with a closed car door leaf and car door/shaft door coupling disposed in an uncoupling setting.
Figure 1B:
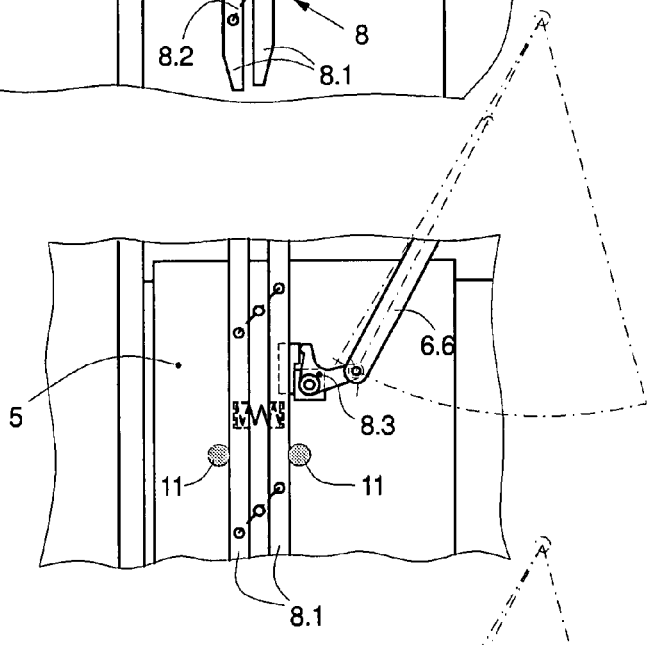
FIG. 1B is a detail of the car door system according to FIG. 1A, with a slightly opened car door leaf and the car door/shaft door coupling disposed in a coupling setting.
Figure 1C:
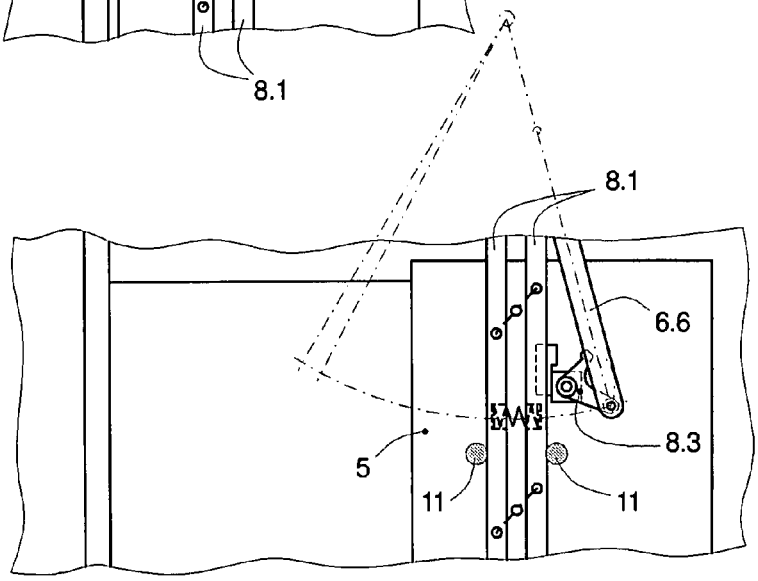
FIG. 1C is a detail of the car door system according to FIG. 1A, with a completely opened car door leaf and the car door/shaft door coupling disposed in the coupling setting.

A prior art original car door system 2 of older mode of construction installed in the region of the front of an elevator car 1 is illustrated in FIGS. 1A, 1B, 1C. This comprises a car door leaf 5 horizontally displaceable in the region of a front wall 1.1 of the elevator car 1 along a guide rail 4, an original door drive 6 and a car door/shaft door coupling 8. The car door/shaft door coupling 8 couples the car door leaf 5 each time to a respective shaft door leaf when at a floor stop of the elevator car the elevator doors are opened and closed again (shaft door leaves are not illustrated here).

It can be seen from FIG. 1A that the original door drive 6 is mounted on a door carrier 1.2 fastened to the elevator car 1 and comprises a door drive motor 6.1, a crank gear 6.2 and a belt reduction gearing 6.3 arranged between the door drive motor and the crank gear. A crank arm 6.4 of the crank gear 6.2 acts by way of a crank rod 6.5 on a door drive arm 6.6, which is connected with the car door leaf 5 by way of an adjusting element, which is constructed as an adjusting lever 8.3, of the car door/shaft door coupling. This original car door system 2 is so designed that a 180 degree rotation of the crank arm 6.4 causes the opening and closing movement of the car door leaf 5 by way of the described lever system. The opening or closing movement also has the consequence of actuation of the car door/shaft door coupling 8 by the door drive arm 6.6 via the adjusting lever 8.3, as can be seen from the movement course illustrated in FIGS. 1A, 1B and 1C. The car door/shaft door coupling 8 comprises two entrainer skids 8.1 which are so mounted on the car door leaf 5 by two articulation levers 8.2 that their mutual spacing is adjustable within defined limits, wherein the entrainer skids 8.1 always remain oriented parallel to one another, i.e. form a so-called entrainer parallelogram.

A spreading spring 10 spreads the entrainer skids 8.1 to a mutual spacing which is determined by the position of the adjusting lever 8.3 of the car door/shaft door coupling 8, which also connects the door drive arm 6.6 with the car door leaf 5. The adjusting lever 8.3 is so shaped and arranged that it is pivoted by the door drive arm 6.6 in the course of the door opening or the door closing movement via a first lever arm 8.3.1 about an axle 8.4, by way of which the adjusting lever 8.3 is connected with the car door leaf 5. The adjusting lever 8.3 has a second lever arm 8.3.2 which so transmits the rotational movement of the adjusting lever to the entrainer skids 8.1 of the entrainer parallelogram that in the course of a first short path section of the opening movement of the car door leaf 5 a spreading of the entrainer skids 8.1 of the car door/shaft door coupling 8 takes place, as is illustrated in FIG. 1B. The car door/shaft door coupling 8 is now disposed in coupling setting, i.e. each of the entrainer skids 8.1 at maximum mutual spacing is in contact with the one of the entrainer rollers 11, which are mounted on the corresponding shaft door leaf.

FIG. 1C shows the position of the door drive arm 6.6 and of the adjusting lever 8.3 in the case of fully opened car door leaf 5 and entrainer skids 8.1 still spread apart. It is achieved by the spreading of the entrainer skids 8.1 during the door opening and door closing process that the entrainer skids remain in contact with the entrainer rollers 11 of the shaft door leaf (the shaft door leaf is not shown in FIGS. 1A to 1C). By way of the said entrainer rollers 11, which are present at each of the shaft doors of the elevator, the shaft door leaf instantaneously opposite the elevator car is also unlocked by the action of the spread entrainer skids 8.1 before this leaf is opened synchronously with the car door leaf 5.

In the succeeding closing movement of the door leaf the spacing between the entrainer skids 8.1 is reduced again to its initial value in the course of a last short path section of the closing movement. FIG. 1A shows the position of the participating components with car door leaf 5 closed and a minimum spacing between the entrainer skids 8.1. The car door/shaft door coupling 8 is thus disposed in uncoupling setting in which the entrainer skids are spaced by the entrainer rollers 11 of the shaft door leaf. The uncoupling at the end of the door closing movement causes relocking of the shaft door leaf in its closed position and enables onward travel of the elevator car 1, wherein the entrainer skids 8.1 of the car door/shaft door coupling 8 move through between the respective two entrainer rollers 11 of the shaft door leaf without coming into contact therewith during the travel.

Figure 2A:
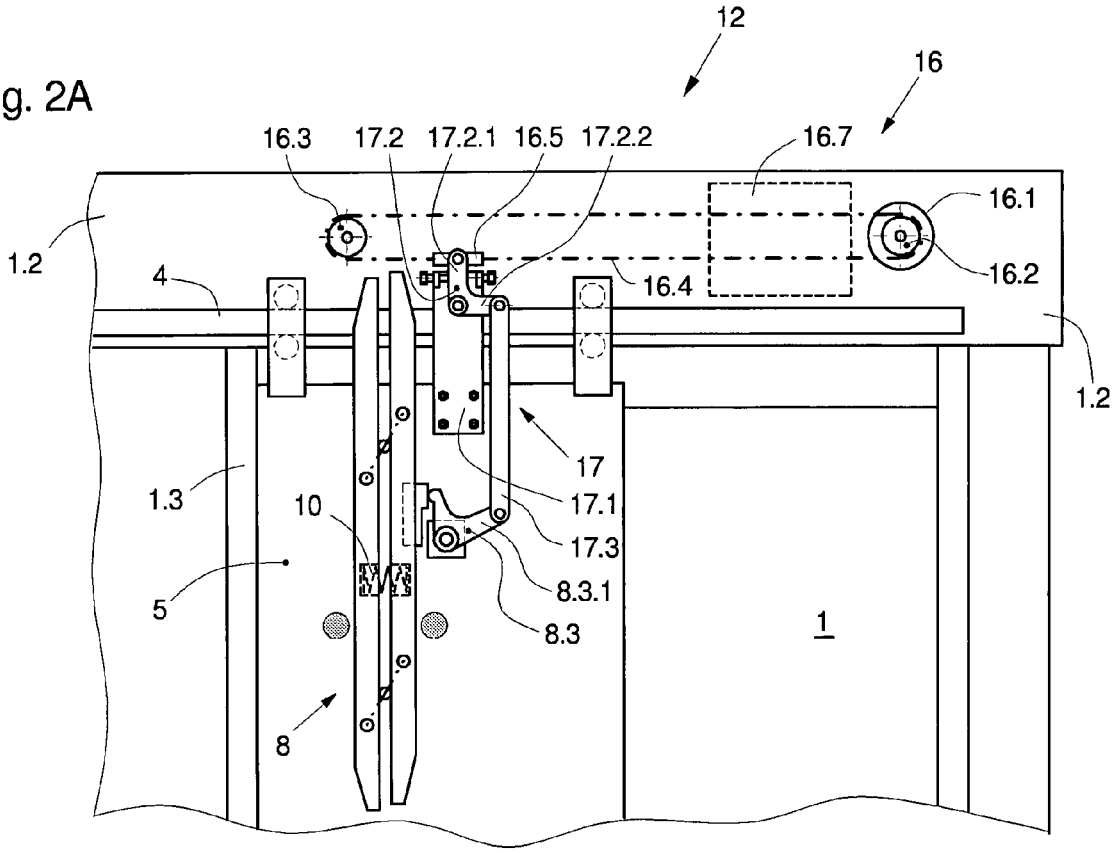
FIG. 2A is a schematic view of a modernized car door system with a linearly moved drive means and actuation of the car door/shaft door coupling by the drive means, with a closed car door leaf and the car door/shaft door coupling disposed in the uncoupling setting.
Figure 2B:
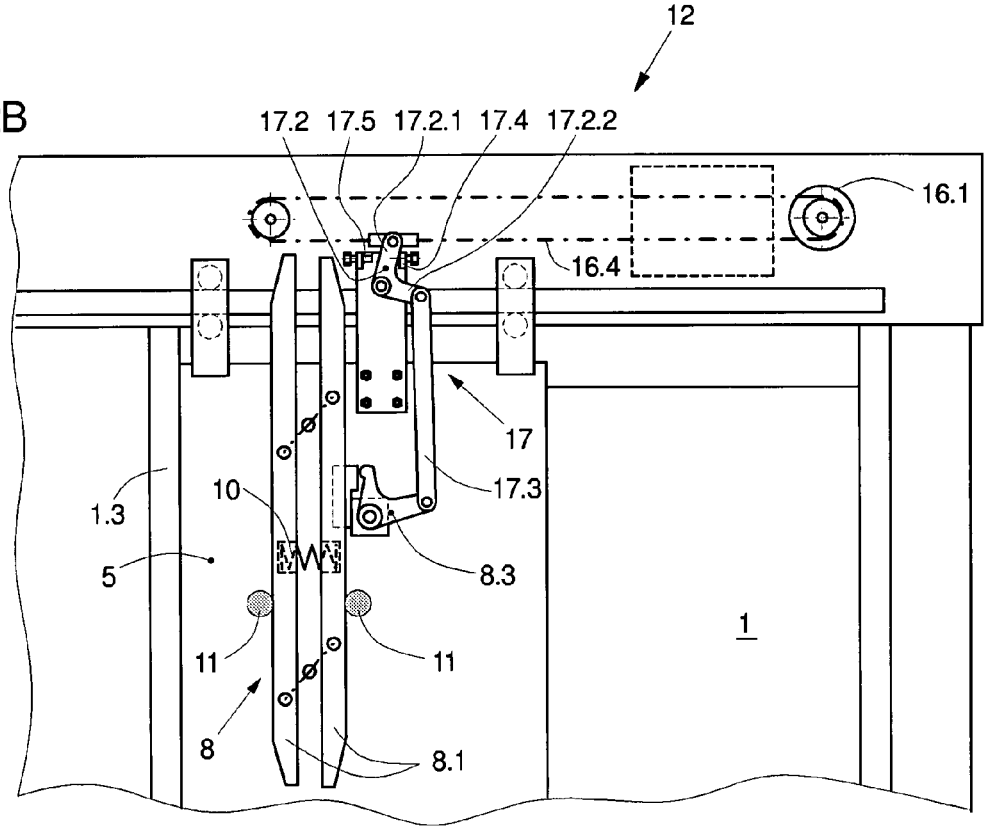
FIG. 2B shows the modernized car door system according to FIG. 2A, at the beginning of the opening movement and the car door/shaft door coupling disposed in the coupling setting.

FIGS. 2A and 2B show a first variant 12 of a car door system modernized in accordance with the present invention. It comprises the original car door leaf 5, which was already present at the original car door 1, with the original guide rail 4 and the original car door/shaft door coupling 8 fastened to the car door leaf. In the region of the original door beam 1.2 the original crank gear door drive has been replaced by a door drive 16 with linearly moved drive means 16.4. The new door drive comprises a regulable door drive motor 16.1 with a drive pulley 16.2 for driving the linearly moved drive means 16.4, a deflecting pulley 16.3 for deflecting the linearly moved drive means, the linearly moved drive means 16.4 itself, which can be present in the form of, for example, a cogged belt circulating around the drive pulley 16.2 and the deflecting pulley 16.3, as well as a coupling element 16.5 which connects the two ends of the linearly moved drive means 16.4 together and couples this with the car door leaf 5. Rotational speed, acceleration, deceleration and torque of the door drive motor are controllable and regulable by means of a control and regulating apparatus 16.7 in dependence on the instantaneous position of the car door leaf 5 in accordance with programmed presets. This enables realization of opening and closing movements of the car door leaf and of the shaft door leaf coupled therewith with an optimum speed course and low door movement times, wherein a secure limitation of the closing force and of the kinetic energy of the door system is guaranteed and the permissible limit values are adapted to given use circumstances.

So that the car door/shaft door coupling 8, which is actuated in the case of the original crank gear door drive by the door drive arm via the adjusting lever 8.3, can also be activated and deactivated by the new linearly moved drive means 16.4, the coupling between the linearly moved drive means 16.4 and the car door leaf 5 is carried out by way of an additional actuating device 17 which is to be mounted. As illustrated in FIG. 2A, this actuating device 17 comprises a coupling plate 17.1, which is fixed on the car door leaf 5, with a double-arm pivot lever 17.2 mounted thereon. The pivot lever 17.2 is coupled by a first lever arm 17.2.1 via the coupling element 16.5 to the linearly moved drive means 16.4 and the second lever arm 17.2.2 of the pivot lever 17.2 acts by way of a transmission element 17.3 on the first lever arm 8.3.1 of the original adjusting lever 8.3 of the original car door/shaft door coupling 8.

FIG. 2A shows the afore-described first variant 12 of the modernized car door system in the setting in which the car door leaf 5 is completely closed and in that case bears against the door post 1.3 of the elevator car 1. The linearly moved drive means 16.4 in that case exerts a biasing force, which is oriented to the left, on the first lever arm 17.2.1 of the pivot lever 17.2 of the actuating device 17, which is transmitted by the second lever arm 17.2.2 of the pivot lever 17.2 via the transmission element 17.3 to the adjusting lever 8.3 of the car door/shaft door coupling 8 so that the adjusting lever 8.3 under the action of the said biasing force fixes the entrainer skids 8.1 of the car door/shaft door coupling 8 in their unspread uncoupling setting against the action of the spreading spring 10. The biasing force exerted on the pivot lever 17.2 by the linearly moved drive means 16.4 for overcoming the force of the spreading spring 10 in that case simultaneously acts as a closing force which presses the car door leaf 5 against the door post 1.3.

At the beginning of the door opening process the door drive motor 16.1 moves the linearly moved drive means 16.4 and thus the first lever arm 17.2.1 of the pivot lever 17.2 of the actuating device 17 to the right, wherein the linearly moved drive means 16.4 as a consequence of the action of the spreading spring 10 of the car door/shaft door coupling 8 exerts a closing force on the car door leaf 5 by way of the pivot lever 17.2 until the first lever arm 17.2.1 of the pivot lever 17.2 abuts against its righthand abutment 17.4. In this coupling setting, which is shown in FIG. 2B, of the modernized door drive system 12 the entrainer skids 8.1 of the car door/shaft door coupling 8 are fully spread by the biasing force of the spreading spring 10 and coupled in play-free manner with the entrainer rollers 11 of the corresponding shaft door leaf (not illustrated), which has also effected unlocking of the shaft door leaf. The further movement of the linearly moved drive means 16.4 to the right now produces the opening movement of the car door leaf 5 in common with the shaft door leaf coupled therewith.

In the case of the door closing process following thereon the linearly moved drive means 16.4 to the left acts on the first lever arm 17.2.1 of the pivot lever 17.2 of the actuating device 17. This first lever arm 17.2.1 is, as a consequence of the action of the spreading spring 10 of the car door/shaft door coupling 8, pressed under bias with sufficient strength against its righthand abutment 17.4 so that the movement, which is directed to the left, of the linearly moved drive means 16.4 initially causes a closing movement of the car door leaf 5 and of the shaft door leaf coupled therewith until the car door leaf hits against the door post 1.3. The force, which is exerted on the first lever arm 17.2.1 of the pivot lever 17.2, of the linearly moved drive means 16.4 now exceeds the force by which the biasing force of the spreading spring 10 presses this first lever 17.2.1 against its righthand abutment 17.4, so that the said first lever arm is moved to the left against the action of the spreading spring 10 and the second lever arm 17.2.2 of the pivot lever 17.2 constrains, by way of the transmission element 17.3 and the adjusting lever 8.3, the entrainer skids 8.1 of the car door/shaft door coupling 8 into their unspread uncoupling setting uncoupled from the entrainer rollers 11 of the shaft door leaf. The movement, which is directed to the left, of the linearly moved drive means 16.4 ends when the first lever arm 17.2.1 of the pivot lever 17.2 has reached its lefthand abutment 17.5, wherein the force, which is to be applied for this pivot movement against the action of the spreading spring 10, of the linearly moved drive means 16.4 simultaneously acts as a closing force on the car door leaf 5, which presses this against the door post 1.3 as long as the closed setting of the door system persists. If this closing force is absent, for example in the case of power failure, then the spreading spring 10 of the car door/shaft door coupling 8 causes spreading of the entrainer skids 8.1. This spreading movement has the consequence that the entrainer skids 8.1 cause, by way of the entrainer rollers 11 of a corresponding shaft door leaf, unlocking thereof if the elevator car is located within a certain tolerance range relative to a shaft door. This behavior is desired and, in the case of power failure, makes possible departure of the passengers from the elevator car when the position thereof with respect to a shaft door allows this.

Figure 3A:
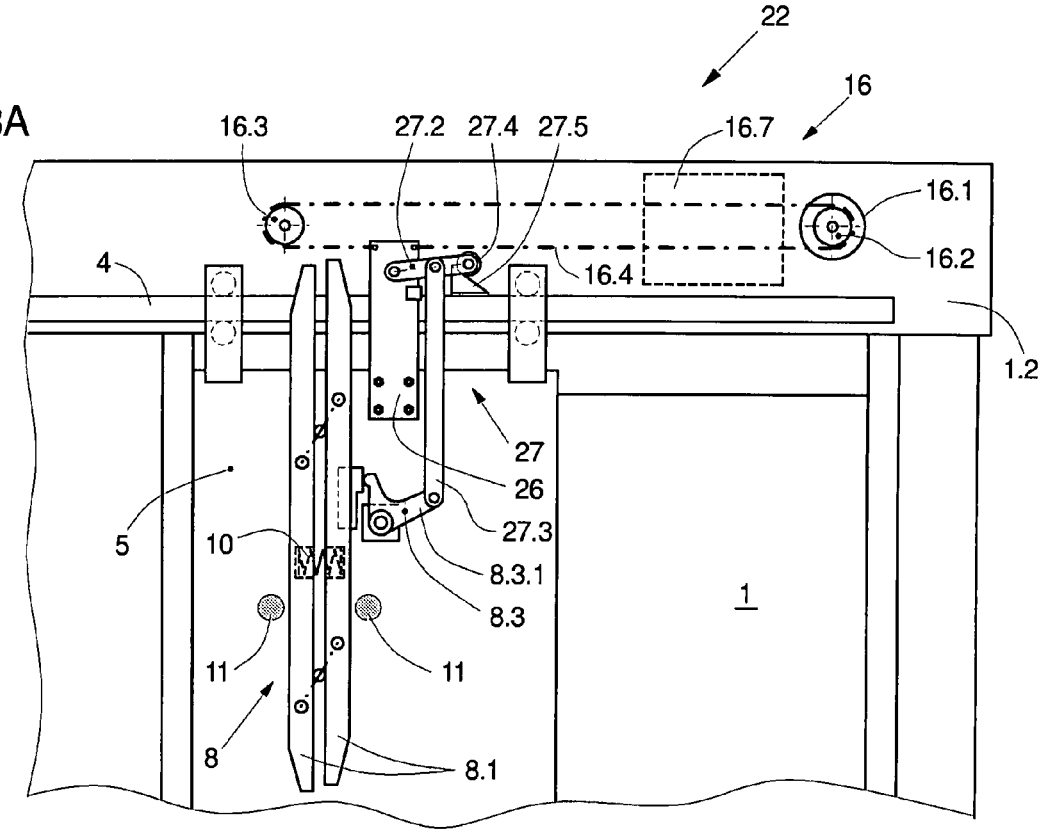
FIG. 3A is a schematic view of a modernized car door system with a linearly moved drive means and actuation of the car door/shaft door coupling by a stationary control cam, with a closed car door leaf and the car door/shaft door coupling disposed in the uncoupling setting.
Figure 3B:
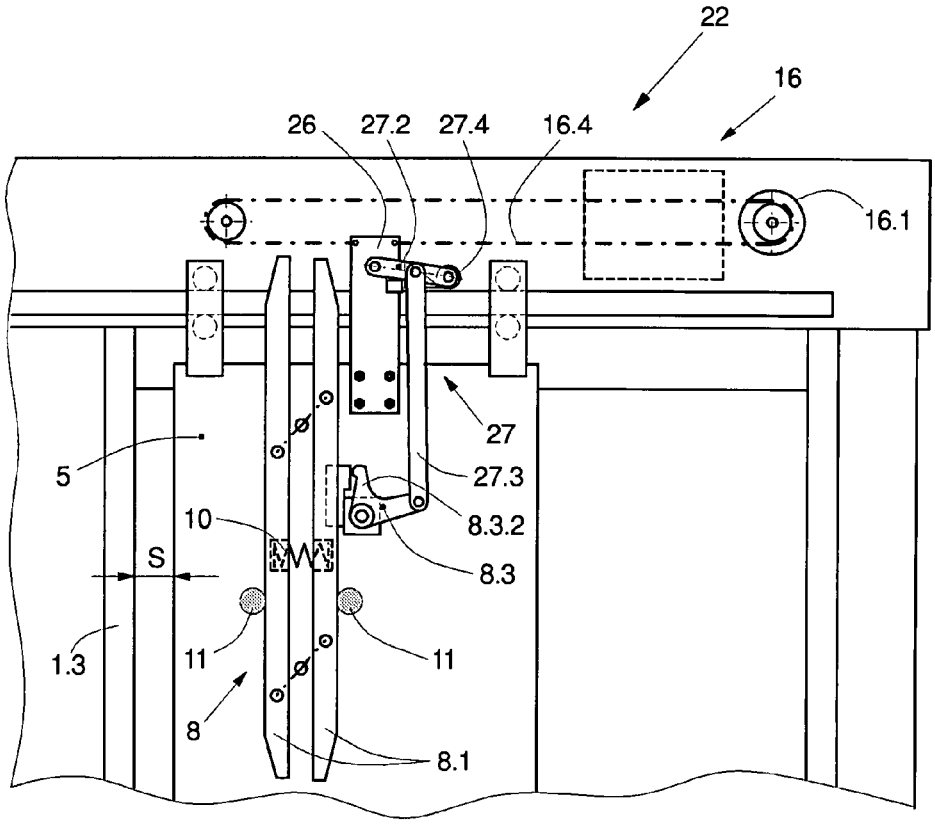
FIG. 3B shows the modernized car door system according to FIG. 3A, at the beginning of the opening movement and the car door/shaft door coupling disposed in the coupling setting.

FIGS. 3A and 3B show a second variant 22 of a modernized car door system according to the present invention. It comprises the original car door leaf 5, which was already present at the original elevator car 1, with the original guide rail 4 and the original car door/shaft door coupling fastened to the car door leaf. In the region of the original door carrier 1.2 the original crank gear door drive has been replaced by a new door drive 16 with linearly moved drive means 16.4. The new door drive comprises a regulable door drive motor 16.1 with a drive pulley 16.2 for driving the linearly moved drive means 16.4, a deflecting pulley 16.3 for deflecting the linearly moved drive means, the linearly moved drive means 16.4 itself, which can be present for example in the form of a cogged belt circulating around the drive pulley 16.2 and the deflecting pulley 16.3. The two ends of the linearly moved drive means 16.4 are connected with a coupling plate 26 which is mounted on the car door leaf 5 and by way of which the linearly moved drive means 16.4 horizontally displaces the car door leaf 5. Rotational speed, acceleration, deceleration and maximum torque of the door drive motor are controllable and regulable by means of a control and regulating apparatus 16.7 in dependence on the instantaneous position of the car door leaf 5 according to program presets. This enables realization of opening and closing movements of the car door leaf and of the shaft door leaf, which is coupled therewith, with optimum speed course and low door movement times, wherein a secure limitation of the closing force and the kinetic energy of the door system is guaranteed and the permissible limit values are adaptable to given circumstances of use.

So that the car door/shaft door coupling 8, which in the case of the original crank gear door drive was actuated by the door drive arm via the adjusting lever 8.3, can also be activated and deactivated by the new linearly moved drive means 16.4, an actuating device 27 has additionally been mounted in the modernization. As illustrated in FIG. 3A, this actuating device 27 comprises a single-arm pivot lever 27.2 mounted on the said coupling plate 26. Rotatably fixed at the righthand end of the pivot lever 27.2 is a control roller 27.4 co-operating with a control cam 27.5, which in the modernization was mounted at the original door carrier 1.2. This control cam 27.5 is so constructed and positioned that it raises the control roller 27.4 of the pivot lever 27.2 and thus the pivot lever itself in the course of a short last path section S of the closing movement of the car door leaf 5. The elevatoring movement of the pivot lever 27.2 is transmitted by way of the transmission element 27.3 of the actuating device 27 to the first lever arm 8.3.1 of the original adjusting lever 8.3, which is a part of the reused original car door/shaft door coupling 8.

FIG. 3 shows the afore-described second variant 22 of the modernized car door system in the setting in which the car door leaf 5 is fully closed and in that case bears against the door post 1.3 of the elevator car 1. The linearly moved drive means 16.4 in that case exerts a closing force, which is directed to the left, on the coupling plate 26 and thus on the car door leaf 5, wherein the closing force is of sufficient size in order to overcome the force, which acts in the opposite direction, of the control roller 27.4, arising due to the fact that this has fixed the entrainer skids 8.1 of the car door/shaft door coupling 8 in their unspread setting, against the action of the spreading spring 10, by way of the pivot lever 27.2, the transmission element 27.3 and the adjusting lever 8.3.

At the beginning of the door opening process the door drive motor 16.1 moves the linearly moved drive means 16.4 and thus the coupling plate 26 and the car door leaf 5 to the right, wherein in the course of a first short path section S of the opening movement the control cam 27.5 enables a downward movement of the pivot lever 27.2 and thus a rotational movement of the adjusting lever 8.3 in clockwise sense, so that the adjusting lever allows spreading of the entrainer skids 8.1 by the force of the spreading spring 10. In this coupling setting, which is shown in FIG. 3B, of the modernized door drive system 22 the entrainer skids 8.1 of the car door/shaft door coupling 8 are fully spread by the biasing force of the spreading spring 10 and coupled in play-free manner with the entrainer rollers 11 of the corresponding shaft door leaf (not illustrated), which has also produced unlocking of the shaft door leaf. The further movement of the linearly moved drive means 16.4 to the right now leads to complete opening of the car door leaf 5 and of the shaft door leaf coupled therewith.

In the closing process following thereon the linearly moved drive means 16.4 acts on the coupling plate 26 by a force directed to the left and moves this together with the car door leaf 5 in direction towards the door post 1.3 until the car door leaf has almost reached its closed setting. In this setting the control roller 27.4 of the pivot lever 27.2 comes into contact with the control cam 27.5, whereupon in the course of a short last section S of the closing path of the car door leaf 5 the control roller together with the pivot lever 27.2 is raised by the control cam 27.5. This has the consequence that the pivot lever 27.2 imparts, by way of the transmission element 27.3, to the adjusting lever 8.3 of the car door/shaft door coupling 8 a rotation in counter-clockwise sense, whereby the second lever arm 8.3.2 of the adjusting lever 8.3 so acts on the entrainer skids 8.1 that these are moved back against the force of the spreading spring 10 into their unspread, uncoupling setting thus uncoupled from the entrainer rollers 11 of the shaft door leaf when the car door leaf 5 has reached its closed setting and bears against the door post 1.3. The uncoupling of the entrainer skids 8.1 and of the entrainer rollers 11 of the shaft door leaf again has the consequence of unlocking of the latter.

As long as the closed setting of the door system persists, the door drive motor 16.1 exerts a closing force on the coupling plate 26 and thus on the car door leaf 5 by way of the linearly moved drive means. If this closing force is absent, for example in the case of power failure, then the spreading spring 10 of the car door/shaft door coupling 8 causes spreading of the entrainer skids 8.1. The spreading movement in turn causes a downward movement of the pivot lever 27.2 by way of the adjusting lever 8.3 and the transmission element 27.3, which has the consequence that the control roller 27.4 of the pivot lever 27.2 produces an opening movement of the car door leaf 5 through co-operation with the control cam 27.5. On the other hand, the spreading movement of the entrainer skids 8.1 causes, by way of the entrainer rollers 11 of a shaft door, unlocking thereof if the elevator car is disposed within a certain tolerance range relative to a shaft door. This behavior is desired and makes possible, in the case of power failure, departure of the passengers from the elevator car when the position thereof with respect to a shaft door permits this.

The method for modernization of a car door system is the same for both afore-described variants of the car door systems modernized in accordance with the invention. In that case, an original car door system 2, which comprises at least one car door leaf 5, a door drive 6 with a crank gear 6.2 and a drive linkage 6.5, 6.6 displacing the car door leaf 5, and a car door/shaft door coupling 8 actuated by the drive linkage, is modernized by the following method steps:

demounting the door drive 6 together with the crank gear 6.2 and the drive linkage 6.5, 6.6, mounting a door drive 16 with a linearly moved drive means 16.4 and coupling the drive means 16.4 to the car door leaf 5 of the original car door system 2, and mounting an actuating device 17; 27 for actuating the car door/shaft door coupling 8.

Obviously the method according to the invention and the modernizing constructional set according to the present invention are also usable for elevator doors which have more than one displaceable door leaf.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of modernizing a car door system of an elevator car, wherein the original car door system includes at least one car door leaf, an original door drive with a crank gear and a drive linkage displacing the car door leaf, the drive linkage including a crank rod and an adjusting element, the crank rod coupled to the crank gear and to the adjusting element, the adjusting element coupled to the door leaf and pivotable about an axis, the adjusting element configured to be pivoted by movement of the crank rod, and a car door/shaft door coupling actuated by the adjusting element of the drive linkage, wherein movement of the crank rod selectively causes the adjusting element to contact the car door/shaft door coupling, the method comprising the steps of:

a. demounting the original door drive together with the crank gear and the crank rod of the drive linkage;

b. mounting a new door drive with a linearly moved drive means; and c. mounting an actuating device for actuating the car door/shaft door coupling, the actuating device including a transmission element being operatively connected to a pivot lever moved by the linearly moved drive means or by a control cam, and the original adjusting element being configured to be activated by the transmission element, wherein movement of the transmission element selectively causes the adjusting element to operate the car door/shaft door coupling.

2. The method according to claim 1 including providing a flexible traction means guided and driven by drive means pulleys as the linearly moved drive means.

3. The method according to claim 1, wherein the drive linkage of the original door drive includes a drive arm disposed between the crank rod and the adjusting element, the drive arm demounted together with the crank gear and the crank rod of the drive linkage prior to the mounting of the actuating device.

4. The method according to claim 1, wherein the actuating device further includes a double-arm pivot lever having a first lever arm and a second lever arm, the pivot lever pivotable about an axis disposed between the first lever arm and the second lever arm, the first lever arm of the pivot lever coupled to the linearly moved drive means and the second lever arm of the pivot lever coupled to the transmission element.

5. The method according to claim 1 including mounting a control cam fixedly connected with the elevator car that produces the movement of the transmission element and the adjusting element by way of a single-arm pivot lever of the actuating device fastened to the car door leaf.

6. The method according to claim 2 including providing one of a cogged belt, a nubbed belt and a link chain as the flexible traction means.

7. The method according to claim 2 including driving at least one of the drive means pulleys and the linearly moved drive means with a door drive motor, and controlling and regulating a rotational speed and torque of the door drive motor with a control and regulating apparatus in accordance with programmed presets.

8. The method according to claim 4, wherein in the course of a last path section of a closing movement of the car door leaf or of the drive means, causing the actuating device to make a movement which brings the car door/shaft door coupling into an uncoupling setting and in the course of a first path section of the opening movement of the car door leaf or of the drive means, causing the actuating device to make a movement which brings the car door/shaft door coupling into a coupling setting.

9. The method according to claim 4, wherein the actuating device further includes a coupling plate, the pivot lever mounted on the coupling plate, wherein the mourning of the actuating device includes affixing the coupling plate on the car door leaf.

10. The method according to claim 4, wherein the linearly moved drive means includes a flexible traction means circulating around a drive pulley and a deflecting pulley, and a coupling element connecting the ends of the flexible traction means and coupling the flexible traction means with the first arm of the pivot lever.

11. The method according to claim 8 including deriving the movement of the transmission element and thus the actuation of the car door/shaft door coupling from the movement of the car door leaf or the movement of the linearly moved drive means.

12. The method according to claim 5 including coupling the pivot lever present at the actuating device with one of the transmission element and the linearly moved drive means so that on the movement of the car door leaf and the movement of the transmission element and of the adjusting element after the conclusion of the closing movement and also before the beginning of the opening movement of the car door leaf are produced by the drive means and the pivot lever.

* * * * *